US006029743A

United States Patent [19]

Czirr et al.

[11] Patent Number: 6,029,743

[45] Date of Patent: Feb. 29, 2000

[54] COMPRESSOR-ASSISTED ANNULAR FLOW

[75] Inventors: Kirk L. Czirr, Midland, Tex.; Mark C. Bickley, Farmington, N.Mex.

[73] Assignee: Phillips Petroleum Company, Bartlesville, Okla.

[21] Appl. No.: 09/031,388

[22] Filed: Feb. 26, 1998

[51] Int. Cl.[7] ..... E21B 43/12

[52] U.S. Cl. ..... 166/167; 166/370; 166/267

[58] Field of Search ..... 166/68, 267, 351, 166/357, 370, 72, 167

[56] References Cited

U.S. PATENT DOCUMENTS

| | | | |
|---|---|---|---|
| 4,171,016 | 10/1979 | Kempton | 166/68 |
| 4,453,599 | 6/1984 | Fredd | 166/374 |
| 4,509,599 | 4/1985 | Chenoweth et al. | 166/370 |
| 4,711,306 | 12/1987 | Bobo | 166/372 |
| 4,790,376 | 12/1988 | Weeks | 166/68 |
| 5,339,905 | 8/1994 | Dowker | 166/369 |
| 5,605,193 | 2/1997 | Bearden et al. | 166/370 |

*Primary Examiner*—Frank Tsay

[57] ABSTRACT

An apparatus and a method for recovering hydrocarbon from a hydrocarbon producing well is provided. The apparatus comprises a two stage compression-assisted annular flow in which a first compression means is connected to a production tubing to flow gas and liquids, and optionally a second compression means is connected to a tubing/casing annulus to flow gas at a relatively unrestricted flow rate. The production tubing comprises a mixing means in the producing formation. Optionally, the tubing/casing annulus comprises a sealing means.

4 Claims, 7 Drawing Sheets

COMPRESSOR-ASSISTED ANNULAR FLOW

FIELD OF THE INVENTION

This invention relates to an apparatus and a process for recovering hydrocarbon fluid from a well and to a method for simultaneously producing hydrocarbon fluid from the well through a tubing and a tubing/casing annulus.

BACKGROUND OF THE INVENTION

A hydrocarbon producing well typically includes two coaxial conduits connecting the underground hydrocarbon reservoir to the surface. The outer conduit (casing) is set permanently in place while the inner conduit (tubing) is removable. The outer conduit is necessarily larger than the inner conduit. Typically, flow of hydrocarbon to the surface is through the inner conduit. However, in cases where the hydrocarbon reservoir has a large potential to produce both liquid and gases, the size of the inner conduit can significantly restrict the producing gaseous flow. In these cases, it is desirable that both gas and liquid flow through the annular space between the outer and inner conduits, providing a larger flow area and resulting in significantly less restriction to flow and higher flow rates. This is known as annular flow. A problem facing such annular flows relates to flow of separate liquid and gas phases where gas is the predominant phase. In order to flow liquid and gas vertically upward when gas is the predominant phase, the velocity of the gas phase must be high enough to lift all of the liquid to the surface (minimum lift velocity). If the gas velocity is too low, liquid will accumulate in the bottom of the annular space and restrict gaseous flow. Under annular flow conditions with the large flow area, gas velocities are minimized creating the potential for liquid accumulation. This liquid accumulation can ultimately shut off virtually all gas flow.

In these cases, it is possible to produce the well simultaneously up the inner and outer conduits, utilizing a compressor on the inner conduit to increase the gas velocity in the inner conduit to a level sufficient to lift the produced fluids out of the wellbore (to the surface). This process is referred to herein as compressor assisted annular flow (CAAF). However, field testing has shown that CAAF can be difficult to initiate in some wells. As the annulus valve is opened to allow flow up the annulus, the resulting reduction in flowing bottom hole pressure causes an initial slug of liquid to enter the inner conduit and the gas flow rates up the inner conduit with the CAAF compressor running are insufficient to lift the liquid slug out of the wellbore. This results in a log off situation in the inner conduit and the compressor shuts down on low suction. The condition is caused by the fact that minimum lift gas velocities are calculated based on the gas velocity needed to carry small droplets of fluid up the hole (mist flow) rather than the velocity needed to lift larger slugs of fluid.

Therefore, there is an ever-increasing need to develop an apparatus and a method for recovering hydrocarbon through the tubing/casing annulus by modifying the downhole configuration to obtain better mixing of a reservoir's gas and liquid production before splitting flow between the inner and outer conduits. It would also be a significant contribution to the art to provide such an apparatus and a method for flowing a hydrocarbon simultaneously through the larger outer conduit and the smaller inner conduit.

SUMMARY OF THE INVENTION

An object of this invention is to provide an apparatus which is useful for recovering a hydrocarbon such as, for example, methane. Another object of this invention is to provide an apparatus which is useful for simultaneously producing hydrocarbon gas and liquid. Also an object of this invention is to provide a method for recovering a hydrocarbon. A further object of this invention is to provide a method for recovering gas from gas wells that also produce a liquid such as, for example, water. An advantage of this invention is the prevention of a continuous slug of liquid fluid from forming in the inner conduit and allowing CAAF to be initiated without difficulty. Another advantage of this invention is that the apparatus and method of this invention can maximize gaseous hydrocarbon production by flowing the majority of the gas from a well up the less restrictive annulus at reduced back pressure relative to the surface gathering or flow line pressure while simultaneously flowing the majority of liquid up the tubing. Other objects and advantages will become more apparent as this invention is more fully disclosed hereinbelow.

According to a first embodiment of this invention, an apparatus useful for recovering a hydrocarbon fluid is provided which comprises: (a) a casing fixed in a wellbore, wherein the casing extends from the surface to a desired depth in the wellbore; (b) a production tubing having a smaller diameter than the casing and comprising a mixing means in fluid communication with the producing formation area wherein the tubing is positioned in coaxial alignment with the casing to form a tubing/casing annulus; the tubing extends above the casing to provide a surface outlet for the tubing; the tubing/casing annulus extends from the surface for fluid communication with the producing formation at its lower end; the tubing/casing annulus comprises at least one sealing means such as a packer at a desired location; and both the tubing outlet and the tubing/casing outlet at the surface are in fluid communication with the producing formation; (c) a first compression means located on the surface and having an inlet and an outlet; (d) a first conduit means for connecting the surface outlet of the tubing to the inlet of the first compression means; (e) a third conduit means for connecting the outlet of the first compression means to a surface gathering system or to the inlet of an optional second compression means; (f) an optional second compression means located on the surface and having an inlet and an outlet; (g) an optional second conduit means for connecting the surface outlet of the tubing/casing annulus to the inlet of the second compression means; and (h) an optional fourth conduit means for connecting the outlet of the second compression means to a surface gas gathering system.

According to a second embodiment of this invention, a method which can be used for recovering hydrocarbon fluid is provided. The method comprises: (a) providing an inner conduit designated a production tubing into a producing formation of a hydrocarbon-producing well within and in coaxial arrangement with an outer conduit thereby forming a tubing/casing annulus; (b) introducing a mixing means into the production tubing in the production formation; (c) introducing a sealing means such as a packer into the tubing/casing annulus; (d) securely connecting a first compression means to the inner conduit; optionally, (e) securely connecting a second compression means to the tubing/casing annulus; and (f) recovering the hydrocarbon through the inner conduit and optionally the tubing/casing annulus using the first and second compression means wherein the casing extends from the surface to a desired depth in the wellbore; the sealing means is introduced into the tubing/casing annulus at a desired location to prevent upward flow through the production tubing which has a smaller diameter than the casing except through the mixing means in the production tubing; the tubing extends above the casing to provide a surface outlet for the tubing; the tubing/casing annulus extends below the surface for fluid communication with a producing formation at its lower end; and both the tubing outlet and the tubing/casing outlet at the surface is in fluid communication with the producing formation.

DETAILED DESCRIPTION OF THE INVENTION

According to the first embodiment of this invention, an apparatus that can be used to recover a hydrocarbon is provided. The apparatus can comprise, consist essentially of, or consist of (a) a casing fixed in a wellbore, wherein the casing extends from the surface to a desired depth in the wellbore; (b) a production tubing having a smaller diameter than the casing and comprising at least one mixer in the fluid phase (at the lower end) of the production tubing, wherein the tubing is positioned in coaxial alignment with the wellbore to form a tubing/casing annulus; the tubing extends above the casing to provide a surface outlet for the tubing; the tubing/casing annulus extends from the surface for fluid communication with a producing formation at its lower end; the tubing/casing annulus comprises at least one sealing means such as a packer in a desired location; and both the tubing outlet and the tubing/casing outlet at the surface are in fluid communication with the producing formation; (c) a first compression means located on the surface and having an inlet and an outlet; (d) a first conduit means for connecting the surface outlet of the tubing to the inlet of the first compression means; (e) a third conduit means for connecting the outlet of the first compression means to the inlet of the second compression means; (f) an optional second compression means located on the surface and having an inlet and an outlet; (g) an optional second conduit means for connecting the surface outlet of the tubing/casing annulus to the inlet of the second compression means; and (h) an optional fourth conduit means for connecting the outlet of the second compression means to a surface gas gathering system. The presently preferred hydrocarbon is natural gas. The term "fluid" refers to, unless otherwise indicated, gas, liquid, or both. The term "liquid" can be water, gas condensate, or mixtures thereof. The term "water" denotes pure water, a solution, or a suspension. The term "packer" as used herein refers to an expandable device that can be used as a seal between the tubing and casing.

Figure 1:
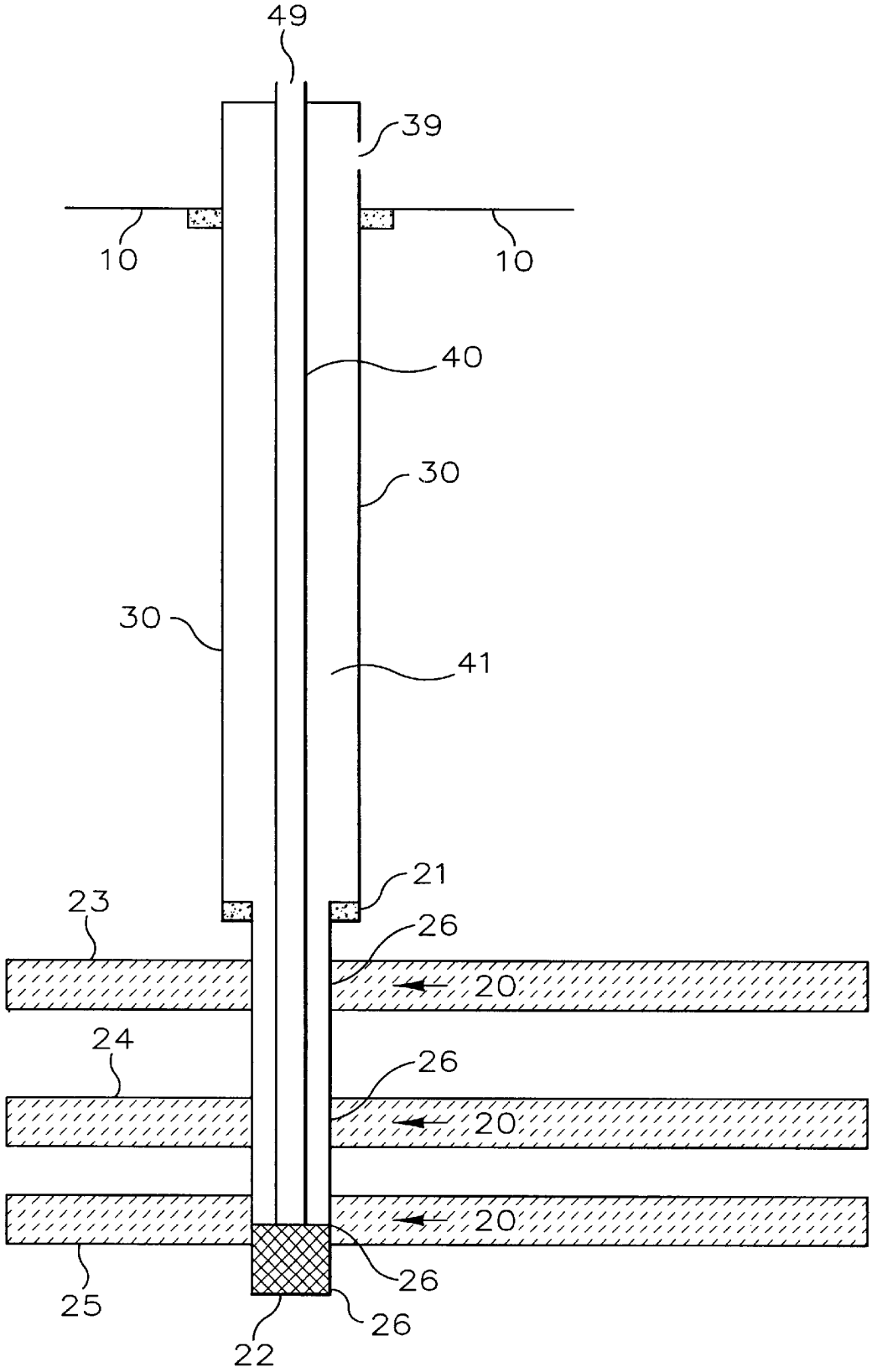
FIG. 1 shows a typical wellbore.

A typical hydrocarbon reservoir penetrated by a well is shown in FIG. 1. A casing 30 is run from the surface 10 of the well to a point near the producing formations 20 along the well to form the outer conduit 30, having a surface outlet 39, and to maintain the integrity of the well. Depending on the well and formation, the diameter of the outer conduit 30 can be in the range of from about 3 to about 20 inches. The portion of the casing, extending from the casing shoe 21 or top of the producing formation to the bottom 22 of the producing formation can be somewhat smaller in diameter than that of the casing above casing shoe 21. For illustrative purposes, a formation as shown in FIG. 1 can also comprise top coal interval 23, middle coal interval 24, and bottom interval 25. Gas and liquid from the producing formation 20 flow toward the casing liner and into the outer conduit through perforated casing or casing liner 26. A tubing string (inner conduit) 40, having a surface outlet 49, is then inserted, within and coaxially aligned with the outer conduit 30, from the surface 10 to the producing formation 20 to form a tubing/casing annulus 41.

Figure 2:
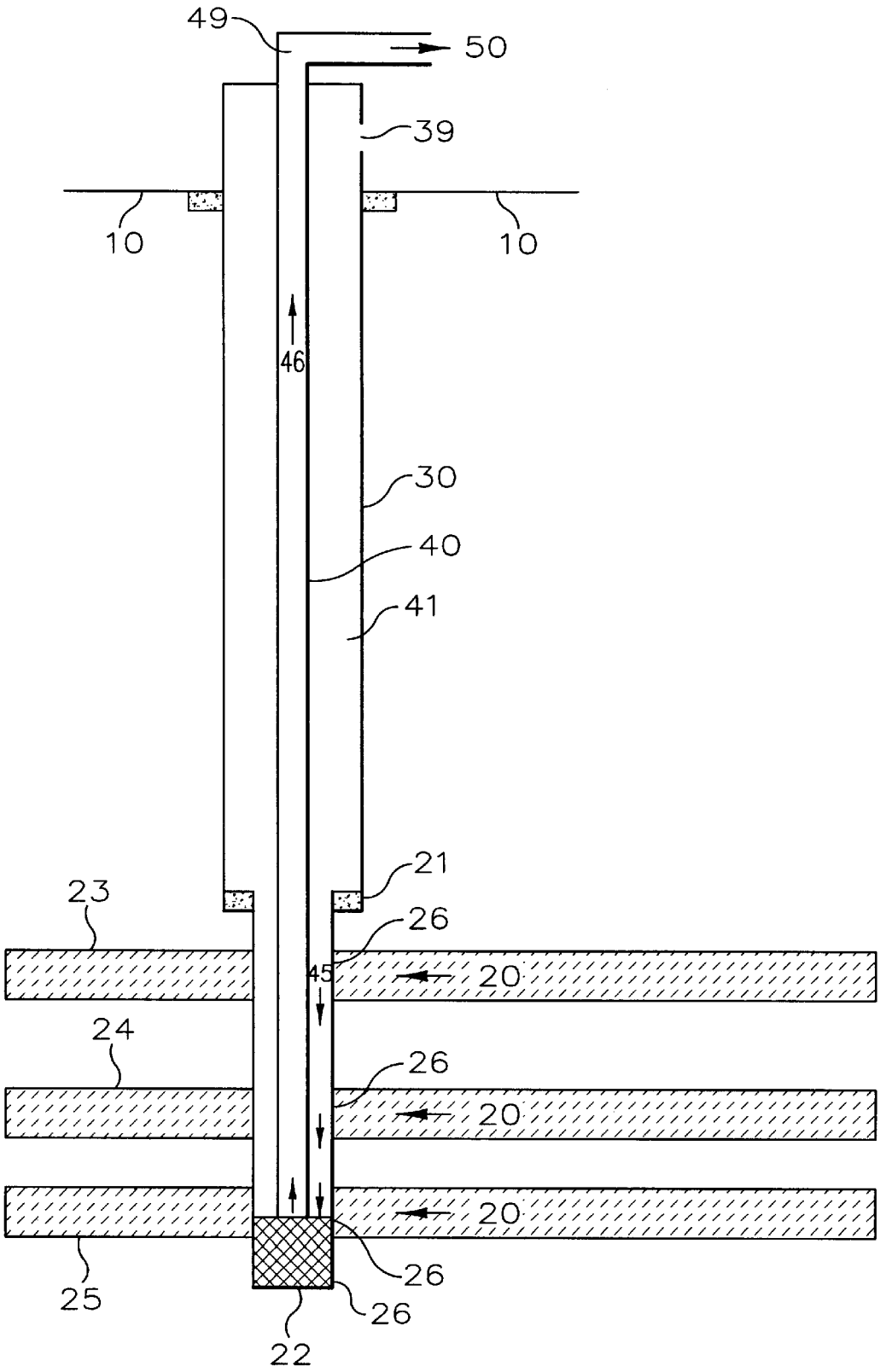
FIG. 2 illustrates normal gas recovery through the inner conduit (tubing).

FIG. 2 shows a method for recovering hydrocarbon from a gas well. In this method, the tubing/casing annulus 41 is shut in at the surface outlet 39. Gas and liquids in which the liquid can include gas condensates and water flow from the producing formation 20 through the perforated casing 26 by first forming a downward flow 45 in the annulus 41 and then up into the tubing 40 to form an upward flow 46 to the surface gathering assembly 50.

Figure 3:
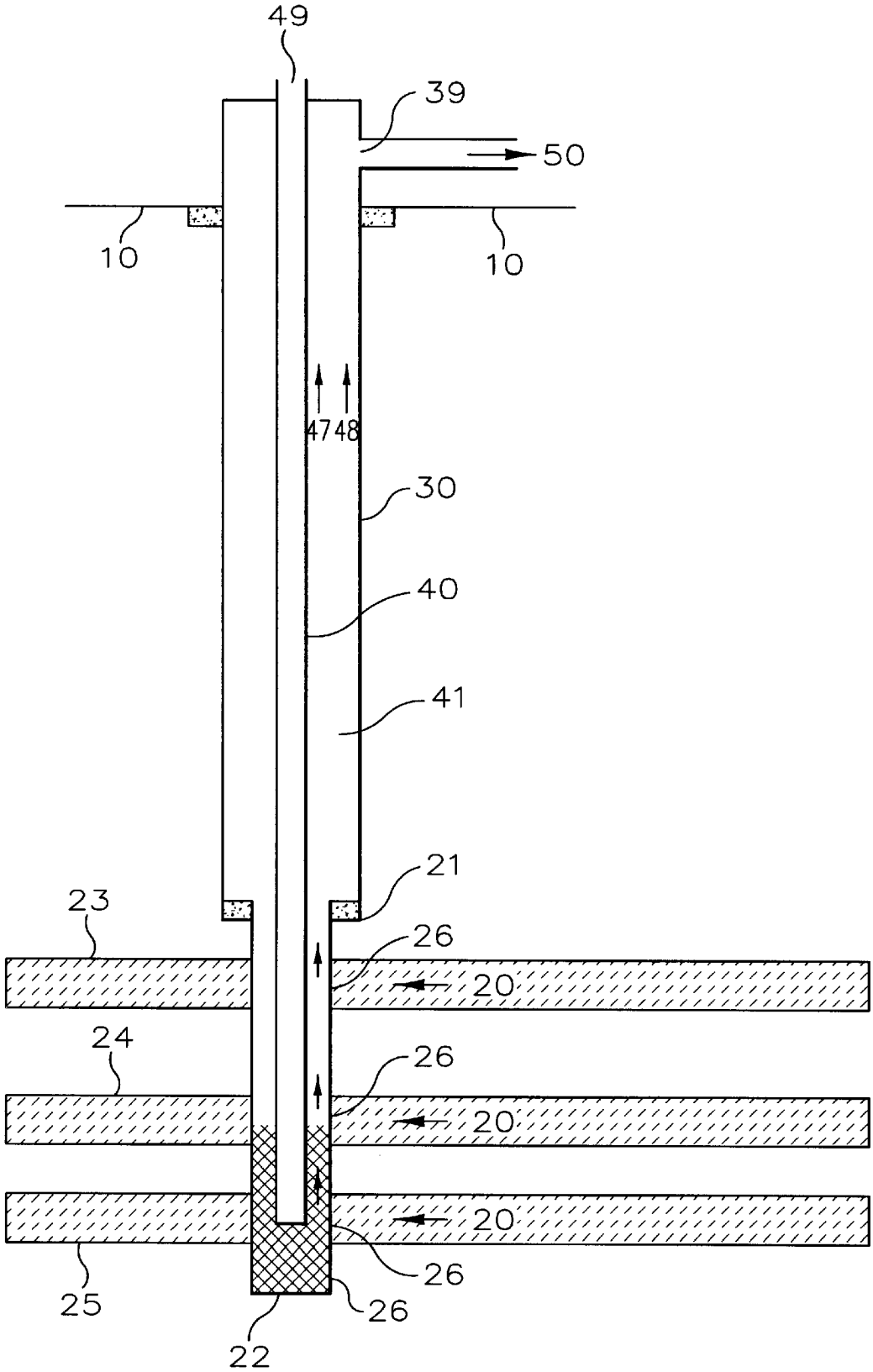
FIG. 3 shows recovery of gas through the tubing/casing annulus or annular flow.

However, when the formation produces a large quantity of fluid, the small tubing significantly restricts the flow. FIG. 3 illustrates the recovery of hydrocarbon through an annular flow. In annular flow, the tubing at the surface outlet 49 is shut in thereby allowing the gas and liquids to flow from the producing formation 20 through the perforated casing 26 to form an upward flows of 47 (gas) and 48 (gas condensates and water) in the tubing/casing annulus 41 and to the surface gathering assembly 50.

As disclosed hereinabove, a problem related to the annular flow is the separate gas phase 47 and liquid phase 48, wherein the gas phase is predominant. Under such a condition, the velocity of the gas phase must be high enough to lift all liquid to the surface. If the gas velocity is not high enough, liquids will accumulate in the bottom of the annular space thereby restricting the flow of both gas 47 and liquid 48 and ultimately shutting off virtually all gas flow.

Figure 4:
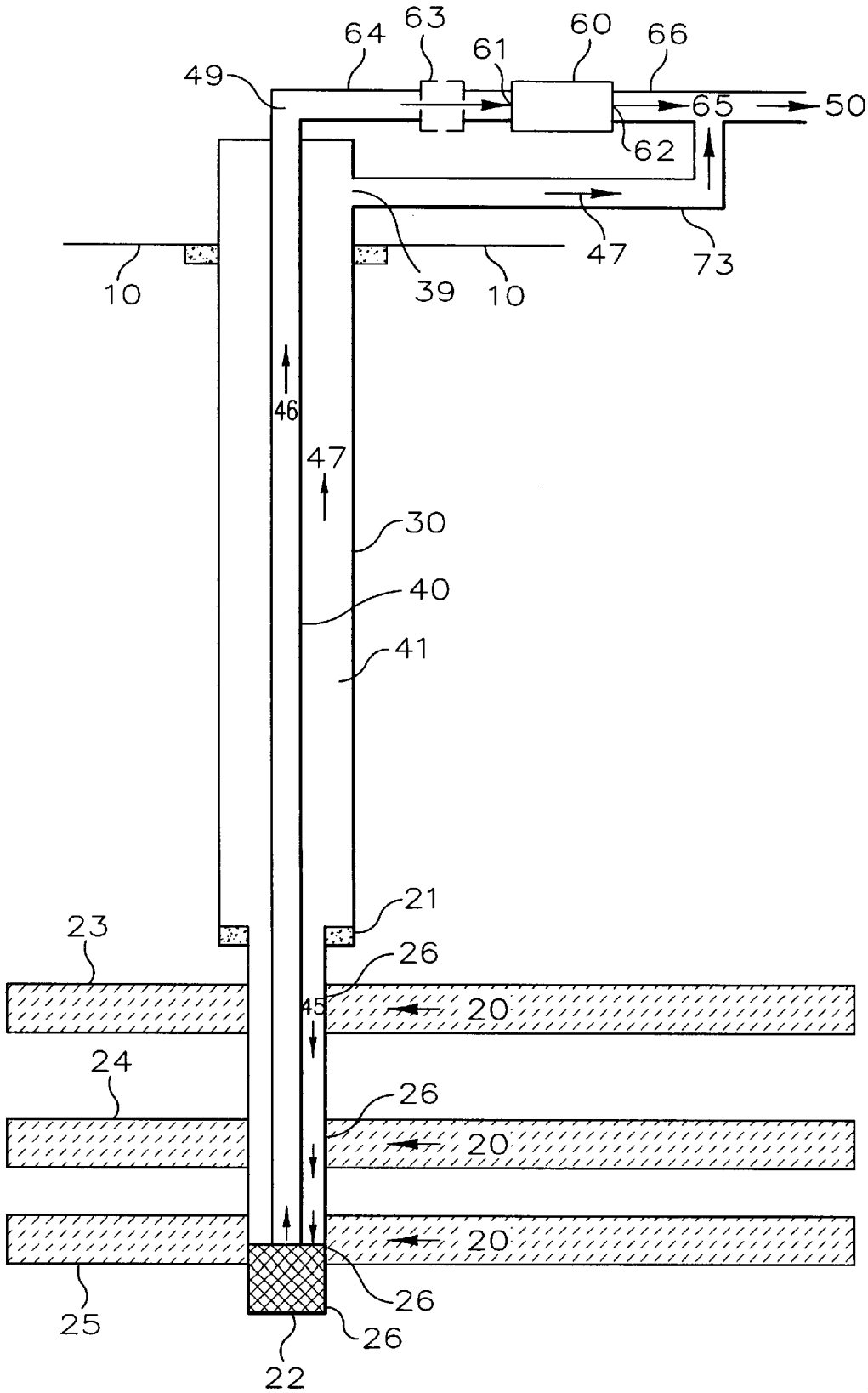
FIG. 4 shows a compressor-assisted annulus flow using a single compressor connected to the outlet of the production tubing.

To solve the problem disclosed above, one can employ the apparatus illustrated in FIG. 4 in which the majority of liquid such as water produced from the well (flow 46) flows through production tubing 40 by the action of compression means 60, which is connected to the production tubing outlet 49. The compression means 60 located on the surface 10 has an inlet 61 and an outlet 62. Inlet 61 is connected to tubing outlet 49 using conduit means 64. The compression means 60 also comprises a gas-liquid separator for the separation of and removal of liquids from gas thereby allowing only gas to enter the compression means 60. Optionally, a separate liquid-gas separator can be fixedly located as shown at 63, using suitable conduit means between the surface outlet 49 and the inlet 61. The gas is discharged at the outlet 62 of compression means 60 as flow 65 which can be combined with flow gaseous 47 which flows through conduit means 73 to form a combined flow to a surface gas gathering assembly 50.

Figure 5:
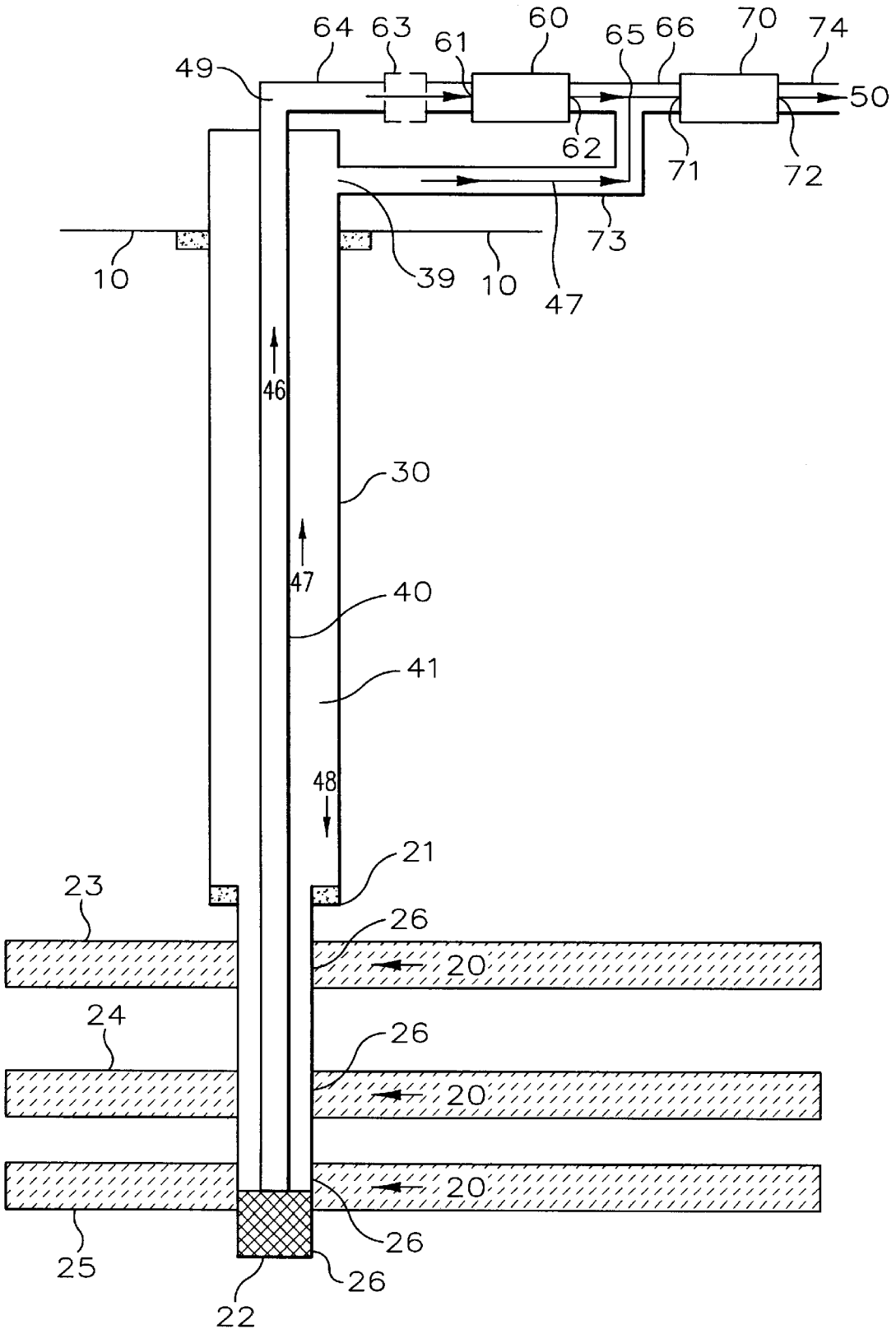
FIG. 5 illustrates a compressor-assisted annular flow in which the gas is recovered through both inner conduit and tubing/casing annulus according to the invention.

Alternatively, the problem can be solved with an apparatus that allows gas and liquid flow simultaneously through the tubing and the tubing/casing annulus. A simple version of the apparatus is shown in FIG. 5. A first compression means 60 having an inlet 61 and an outlet 62 is located on the surface 10. The inlet 61 of the compression means 60 is connected to the outlet 49 of the tubing (inner conduit) 40 using conduit means 64. Inlet 61 is the suction side of the compression means 60 which, when connected to the tubing outlet 49, aids the continuous removal of a majority of water produced from the well (flow 46) through tubing 40. Generally, the compression means 60 also comprises a gas-liquid separator allowing the separation and removal of liquids from gas thereby allowing only gas phase to enter the compression means 60. Optionally, a separate liquid-gas separator 63 can be fixedly located between the surface outlet 49 of the tubing 40 and the inlet 61 of the compressions means 60 by using suitable conduit means. The gas phase is discharged through the outlet 62 of the compression means 60. The discharged gas 65 of compression means 60 is connected, through conduit means 66 to the inlet 71 of a second stage compression means 70, which also comprises an outlet 72 to discharge gas to surface gas gathering system 50.

The inlet 71 of the second compression means 70 is also connected to the surface outlet 39 of the tubing/casing annulus 30 by conduit means 73. The conduit means 73 is connected to, and is in fluid communication with, the conduit means 66. As such, the gas flow 47 produced through the tubing/casing annulus 41 and the discharged gas 65 from the compression means 60 enter the inlet 71 of the compression means 70 through the conduit means 66. The gas discharged from the outlet 72 of the compression means 70 can be transported to a surface gas gathering assembly 50 through a fourth conduit means 74. An optional gas-liquid separator (not shown in FIG. 5) can also be installed between the surface outlet 39 and the inlet 71 of the compression means 70.

A majority of gas 47, including water vapor, flows up the tubing/casing annulus and water or water condensate 48 falls to the bottom of the formation. In the mean time, flow 46 which includes a majority of water produced in the well and gas flows up the tubing 40.

As disclosed above, opening the valve of tubing/casing annulus to allow flow to flow up the annulus can often result in a reduction in flowing bottom hole pressure causing an initial slug of mostly liquid to enter the inner conduit (production tubing) and, consequently, the gas flow rates up the inner conduit with a compression means are insufficient to lift the liquid slug out of the wellbore. The problem can be solved by the present invention disclosed herein.

Figure 6:
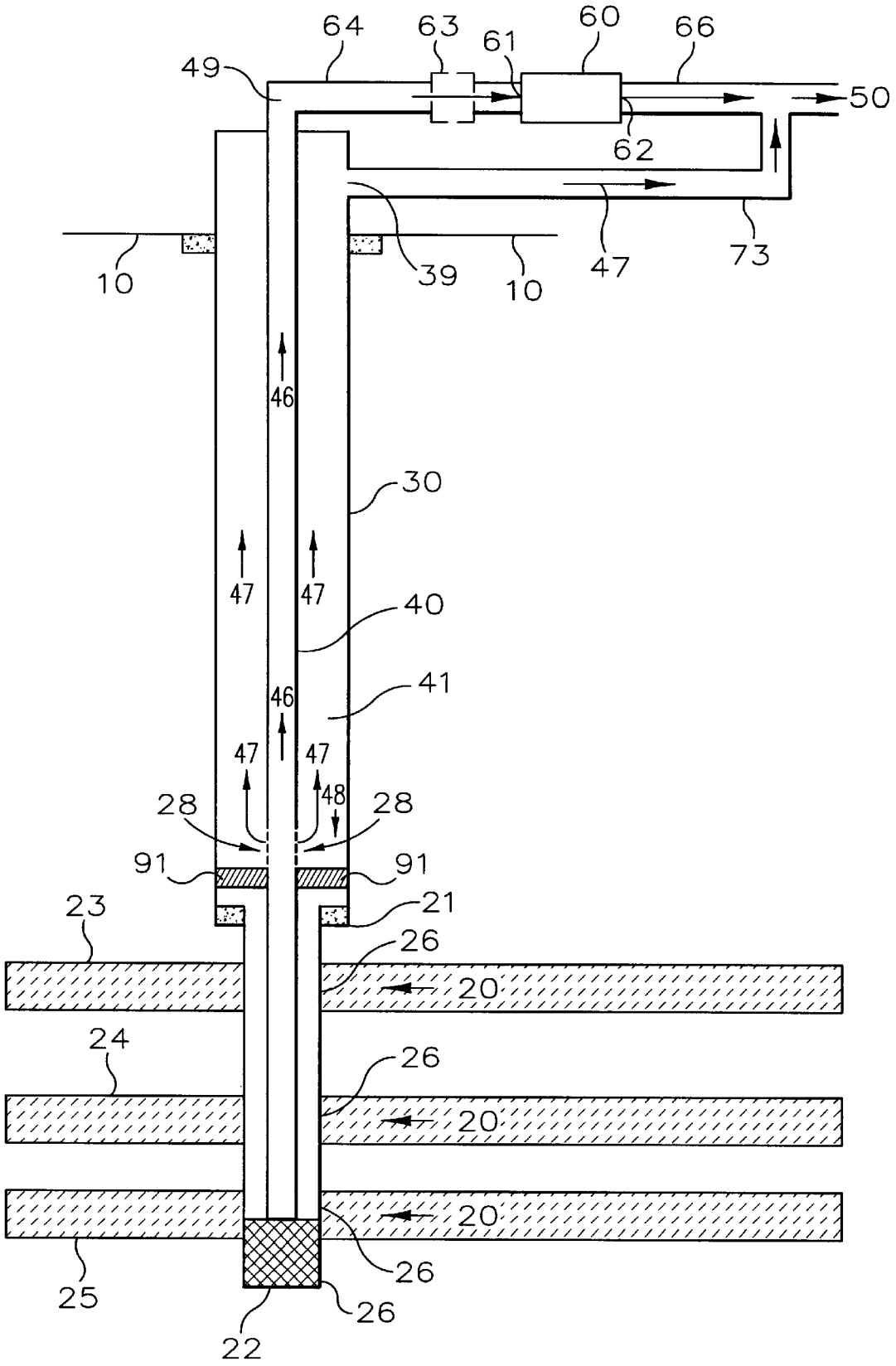
FIG. 6 illustrates an embodiment of the invention in which the tubing/casing annulus comprises and is sealed by a packer and the production comprises a mixer with a single stage CAAF.
Figure 7:
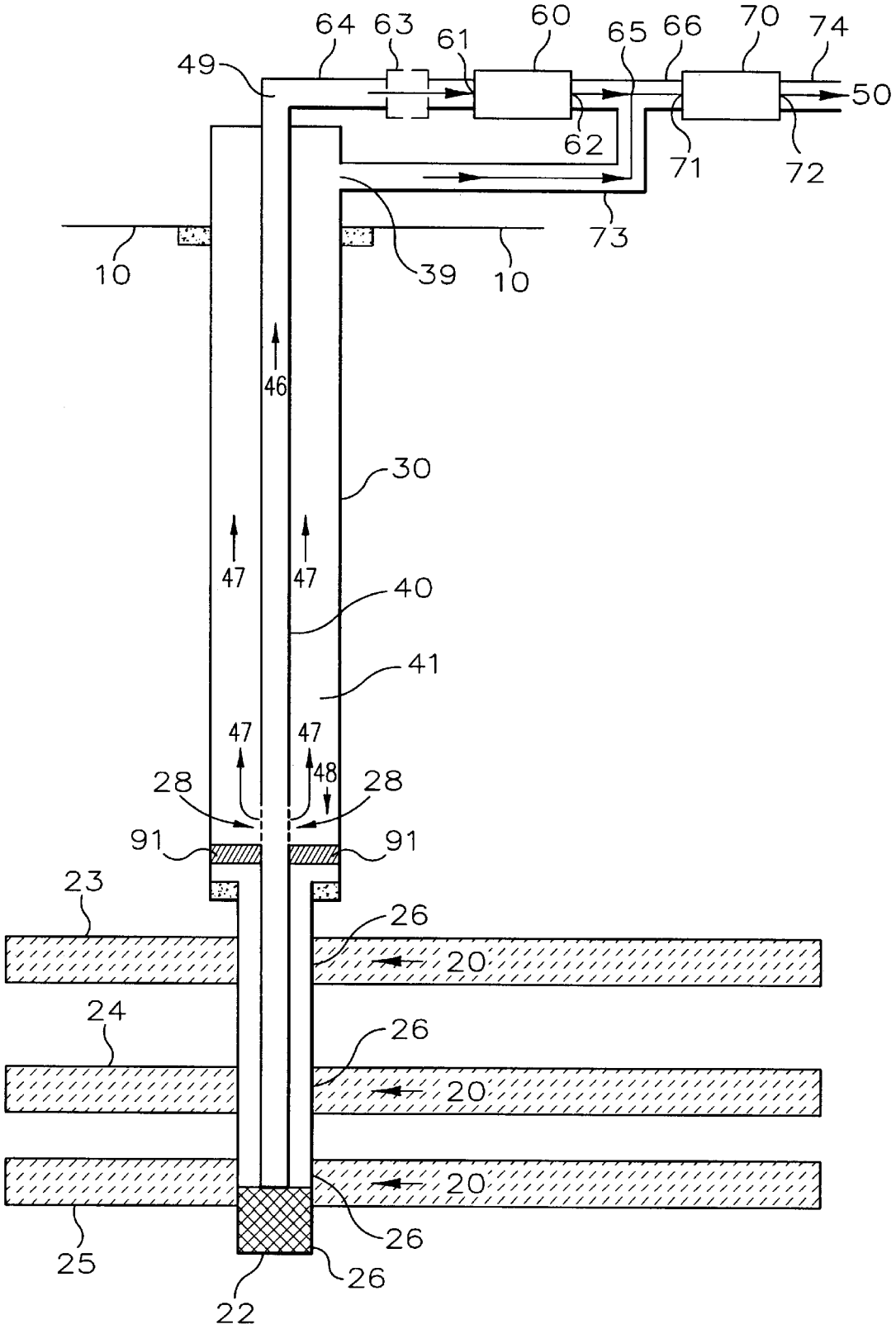
FIG. 7 illustrates another embodiment of the invention in which the tubing/casing annulus comprises and is sealed by a packer and the production comprises a mixer in a two stage CAAF.

According to the present invention, in an apparatus comprising either a single or a two-stage compressor-assisted annular flow system can further comprise a mixing means in the production formation region (fluid region) of the production tubing and a packer 91 in the tubing/casing annulus at a desired location as illustrated in FIG. 6 and FIG. 7.

According to the present invention, any mixing means can be used so long as the mixing means can mix the gas and liquid to form substantially a mist fluid before the gas and liquid split between the production tubing and tubing/casing annulus. Examples of suitable mixing means include, but are not limited to, gas agitation, mechanical agitation, a conduit sufficient small enough so that gas and water cannot separate, and combinations of two or more thereof. The presently preferred mixing means is referred to herein as a tailpipe, a pipe hanging below a packer and is defined as that part of a short liner conduit in the well extending from a packer sealing of the tubing/casing annulus space. Above the point of packer 91, the flow stream splits, with gas and water being produced (flow 46, FIG. 6 or FIG. 7) up the production tubing and the remaining gas (flow 47) flowing up through annulus.

The mixing means such as the tailpipe can be introduced into the producing formation section of the production tubing by any means such as using a conventional hanging means that suspends a casing, tubing, or liner in a well. The packer can be introduced into the annulus 41 at any desired location, preferably above the production formation or the casing shoe 21. More preferably, the packer is introduced immediately or slightly above the producing formation or the casing shoe. Flow 47, mainly gas, flows through perforated producing tubing 28 in production tubing 40.

Also according to the present invention, the function of the first compression means, or the second compression means, or both, can also comprise or be accompanied by a multistage compressor. A multistage compression refers to two or more interconnected compressors or stages of compression.

According to the second embodiment of this invention, a method for producing a hydrocarbon is provided. In the first step of the method, a casing 30 is inserted, extending from the surface 10, into the producing formation 20 of a hydrocarbon-producing well by any methods known to one skilled in the art. Thereafter, an inner conduit designated as tubing 40 which has perforated region 28 is inserted, from the surface 10, into the producing formation 20 of the hydrocarbon-producing well. The tubing 40 is inserted such that it is within and substantially in coaxial alignment with the casing 30. Upon the insertion of tubing 40, a tubing/casing annulus 41 is formed. A packer 91 is simultaneously or thereafter introduced into the annulus 41, preferably immediately above the producing formation and below the perforated section 28 of the producing tubing allowing the gas flow 47 to flow up through 28 and annulus 41.

Thereafter, a first compression means 60 is securely connected to the surface outlet 49 of the tubing 40 through a first conduit means 64. Optionally, if the compression means 60 does not comprise a liquid-gas separator, a separate liquid-gas separator 63 can be installed between the surface outlet 49 and the inlet 61 of the compression means 60. A second compression means 70 can then be optionally securely connected to the surface outlet 39 of the tubing/casing annulus 41 using a second conduit means 73. The hydrocarbon can simultaneously be recovered through the tubing 40 and the tubing/casing annulus 41. Gas and water flow up the tubing 40, aided by the action of the compression means 60, are separated by the gas-liquid separator of the compression means 60 or by the optional separator 63. Produced gas then enters the compression means 60 and is discharged at the outlet 62 forming gas flow 65. Gas containing relatively small quantity of water vapor flows up in the tubing/casing annulus as flow 47 by the action of the compression means 70. In one aspect of this invention, the pressure of discharged gas flow 65 is higher than that of the flow 46 in tubing 40 and can be so adjusted that equalizes the pressure of the flow 47. Such pressure adjustment can be done, for example, by varying the rotational speed of the compression means 60.

The method of this invention can have special applications to high rate gas wells that also produce liquids. The method can maximize well production because the majority of the gas flows up the less restrictive annulus at reduced back pressure relative to surface gathering or flow line pressure. The second stage compression means is efficient because the vast majority of the back pressure reduction achieved at the surface is transferred to the bottom of the wellbore without friction losses, resulting in the lowest economically feasible flowing bottom hole pressure. At the same time, gas and associated fluids are produced through the inner conduit at sufficient velocity to prevent fluid loading problems. Performing the above operations with a two stage compression provides maximum operational flexibility since the compression means horsepower can be reallocated as necessary between the two compression stages.

The results shown in the above examples clearly demonstrate that the present invention is well adapted to carry out the objects and attain the end and advantages mentioned as well as those inherent therein. While modifications may be made by those skilled in the art, such modifications are encompassed within the spirit of the present invention as defined by the specification and the claims.

What is claimed is:

1. A compressor assisted annular flow apparatus for producing hydrocarbon from a hydrocarbon producing formation comprising:

(a) a casing fixed in a well bore wherein said casing extends from the surface to a desired depth below the producing zone of a producing formation, said casing having a lower portion thereof traversing at least one producing zone of said producing formation and being so perforated as to permit the flow of fluids from said production zone into same;

(b) a production tube extending from the surface to the bottom of the well as established by the perforated casing so as to form an annulus between the inner surface of the casing and the outer surface of said production tube, said production tube having a perforated section in same which is at a location above the production zones of said producing formation and a mixing means at the lower end of said production tube so as to be in fluid communication with the fluids produced by the producing formation so as to effect the mixing of fluids passing from said production zone and the annulus formed by said perforated casing into said production tube, and wherein said production tube has an upper end thereof so adapted as to provide a surface outlet for same;

(c) packing means positioned in said annulus at a point below the perforated zone in said production tube and above said producing formation so as to preclude flow of fluids in the annulus below the packing means other than through the lower end of said production tube;

(d) a first compression means having an inlet and an outlet;

(e) first conduit means for connecting the surface outlet of said production tube to the inlet of said first compression means;

(f) second conduit means for connecting the outlet of said first compression means to a surface gathering assembly; and (g) third conduit means for connecting the upper end of the annulus formed by said casing and said production tube to a surface gathering assembly.

2. The apparatus of claim 1 wherein liquid gas separating means is provided in said first conduit means between said surface outlet and said inlet to said compressor.

3. An apparatus in accordance with claim 1 further comprising a second compressor having an inlet and outlet and so adapted that the flow from the outlet of said first compressor passes to the inlet of said second compressor and the flow of fluid in said third conduit passes to the inlet of said second compressor and there is conduit means in association with the outlet of said second compressor to pass the flow from said second compressor to a surface gathering assembly.

4. An apparatus in accordance with claim 3 wherein there is provided a liquid gas separating means in said first conduit between the outlet of said production tube and the inlet to said compressor.

* * * * *